US006561292B1

(12) United States Patent
Portwood

(10) Patent No.: US 6,561,292 B1
(45) Date of Patent: May 13, 2003

(54) ROCK BIT WITH LOAD STABILIZING CUTTING STRUCTURE

(75) Inventor: Gary R. Portwood, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/705,988

(22) Filed: Nov. 3, 2000

(51) Int. Cl.[7] ..... E21B 10/16
(52) U.S. Cl. ..... 175/376; 175/431
(58) Field of Search ..... 175/331, 341, 175/343, 349, 376, 378, 431

(56) References Cited

U.S. PATENT DOCUMENTS

| | | | | |
|---|---|---|---|---|
| 3,696,876 A | * | 10/1972 | Ott | 175/374 |
| 4,187,922 A | * | 2/1980 | Phelps | 175/374 |
| 4,420,050 A | * | 12/1983 | Jones | 175/374 |
| 4,611,673 A | | 9/1986 | Childers et al. | 175/340 |
| 4,815,342 A | | 3/1989 | Brett et al. | |
| 4,848,476 A | * | 7/1989 | Deane et al. | 175/340 |
| 4,989,680 A | | 2/1991 | Deane et al. | 175/340 |
| 5,351,770 A | * | 10/1994 | Cawthorne et al. | 175/374 |
| 5,353,885 A | * | 10/1994 | Hooper et al. | 175/378 |
| 5,421,423 A | | 6/1995 | Huffstutler | 174/374 |
| 5,787,022 A | | 7/1998 | Tibbitts et al. | |
| 5,950,747 A | | 9/1999 | Tibbitts et al. | |
| 6,021,377 A | | 2/2000 | Dubinsky et al. | |
| 6,095,262 A | * | 8/2000 | Chen | 175/57 |
| 6,443,246 B1 | | 9/2002 | Pessier et al. | 175/378 |

FOREIGN PATENT DOCUMENTS

| | | | |
|---|---|---|---|
| GB | 2 368 601 A | 5/2002 | E21B/10/16 |
| WO | WO 00/12859 | 3/2000 | |
| WO | WO 00/12860 | 3/2000 | |

OTHER PUBLICATIONS

Dekun Ma et al.; "The Computer Simulation of the Interaction Between Roller Bit and Rock", International Meeting on Petroleum Engineering; Beijing, PR China; Nov. 14–17, 1995; pp. 309–317.
Great Britain Search Report dated Feb. 11, 2002, 5 pages.
United Kingdom Search Report dated Dec. 3, 2002 (1 page).

* cited by examiner

*Primary Examiner*—Frank S. Tsay
(74) *Attorney, Agent, or Firm*—Rosenthal & Osha L.L.P.

(57) ABSTRACT

One aspect of the invention is a roller cone drill bit including a bit body having three legs depending therefrom, each leg having a journal, a roller cone rotatably mounted on each journal, and each roller cone having a plurality of cutting elements thereon. The cutting elements are arranged in rows on each cone. The rows include at least a gage row and a first row interior of the gage row. The first interior row is staggered with respect to the gage row on each of the three cones. Another aspect of the invention is a roller cone drill bit including a bit body having three legs depending therefrom. Each leg has a journal, a roller cone rotatably mounted on each journal, and each roller cone has a plurality of cutting elements thereon. The cutting elements are arranged in rows on each cone. The rows include at least a gage row and a first row interior of the gage row. The first interior row is staggered with respect to the gage row on at least two of the three cones. The cutting elements have an extension to diameter ratio of at least 0.829.

39 Claims, 16 Drawing Sheets

SMITH TOOL BIT NOMENCLATURE
PREFIXES

F = Journal Bearing
M = Steerable-motor bit bearing
S = Sealed roller bearing

SUFFIXES

A = Designed for air applications
C = Center jet
D = Diamond-enhanced gage inserts
DD = Fully diamond-enhanced cutting structure
E = Full-extended nozzles
G = Super D-Gun coating
H = Heel inserts on milled tooth bits. Different, high wear-resistant grade of carbide on TCI bits for abrasive formations
L = Lug pads
N = Nominal gage diameter
OD = Diamond-enhanced heel row inserts
P = Carbide compact in the leg back
PD = Diamond SRT in the back of the leg
Q = Flow plus tubes
R = SRT inserts pressed in leg for stabilization
S = Sealed roller bearing

MAGNUM SERIES SUFFIXES

M = Roller Bearing
MD = Roller bearing, Diamond chisel gage
MF = Journal bearing, Trucut gage
MFD= Journal Bearing, Diamond chisel gage
Y = Conical cutting structure

MILLED TOOTH CUTTING STRUCTURE
DESIGNATIONS

DS = Very soft formation cutting
DT = Soft formation cutting structure
DG = Medium formation cutting
V = Medium-hard formation cutting Structure

*Fig. 3B*

TCI CUTTING STRUCTURE
DESIGNATIONS

01 = Very soft formation chisel crest cutting structure
02 = Very soft formation chisel crest cutting structure
05 = Very soft formation chisel crest cutting structure
07 = Soft formation conical cutting structure
1 = Soft formation chisel crest cutting structure
10 = Soft formation chisel crest Magnum cutting structure
12 = Soft-medium soft formation chisel crest cutting structure
15 = Soft-medium formation chisel crest cutting structure
17 = Soft-medium formation conical cutting structure
2 = Soft-medium formation chisel cutting structure
20 = Soft-medium formation chisel crest Magnum cutting structure
25 = Medium formation chisel crest cutting structure
27 = Medium formation conical cutting structure
3 = Medium formation chisel crest cutting structure
35 = Medium formation chisel crest cutting structure
37 = Medium formation conical cutting structure
4 = Medium formation chisel crest cutting structure
45 = Medium-hard formation chisel crest cutting structure
47 = Medium-hard formation conical
5 = Medium-hard formation chisel crest cutting structure
57 = Medium-hard formation conical cutting structure
67 = Hard formation conical cutting structure
7 = Hard formation conical cutting structure
8 = Hard formation conical cutting structure
9 = Hard formation conical cutting structure

| POINT REFERENCE NO. (FIG. 11) | CUTTING ELEMENT EXTENSION TO DIAMETER RATIO | % BOTTOM HOLE COVERAGE GAGE/ FIRST INTERIOR ROWS |
|---|---|---|
| 113A | 0.330 | 42.30 |
| 113B | 0.436 | 36.44 |
| 113C | 0.490 | 48.32 |
| 113D | 0.520 | 50.67 |
| 113E | 0.560 | 50.65 |
| 113F | 0.592 | 51.80 |
| 113G | 0.658 | 45.30 |
| 113H | 0.688 | 49.53 |
| 113I | 0.747 | 54.45 |
| 113J | 0.769 | 58.03 |
| 113K | 0.800 | 60.88 |
| 113L | 0.875 | 61.81 |
| 113M | 1.040 | 65.57 |

*Fig. 12*

ROCK BIT WITH LOAD STABILIZING CUTTING STRUCTURE

BACKGROUND OF THE INVENTION

1. Technical Field

The invention relates generally to roller cone drill bits used to drill wellbores through earth formations. More specifically, the invention relates to particular structures for roller cone drill bits having increased drilling efficiency and life expectancy.

2. Background Art

Roller cone drill bits are commonly used for drilling wells in the petroleum industry. FIG. 1 illustrates one example of a roller cone bit used in a conventional drilling system for drilling a well bore in an earth formation. The drilling system include a drilling rig 10 used to turn a drill string 12 which extends downward into a wellbore 14. Connected to one end of the drill string 12 is a roller cone drill bit 20.

As shown in FIG. 2, the roller cone bit 20 includes a bit body 22 having an externally threaded connection 24 at one end, and a plurality of roller cones 26 attached at the other end of the bit body 22 and able to rotate with respect to the bit body 22. FIG. 2 shows the roller cone bit 20 having three roller cones 26 which is the number typically used in the prior art. Attached to the roller cones 26 are a plurality of cutting elements 28 typically arranged in rows about the surface of the roller cones 26. The cutting elements 28 may be formed from a variety of substances, including tungsten carbide inserts, polycrystalline diamond inserts, boron nitride inserts, milled steel teeth, or other suitable materials. Additionally, the cutting elements 28 may be coated with a hardfacing material (not shown) to enhance the durability of the cutting elements 28.

Typically, prior art drill bits have been designed through a trial and error process that included selecting an initial design, field testing the initial design, and then modifying the design to improve drilling performance. Prior art bits used for soft to medium hardness formations typically have at least one roller cone with a "staggered" row of cutting elements on that cone. FIG. 3A illustrates what is meant by a staggered row. FIG. 3A shows an oblique view of a single roller cone 30 which includes a gage row of cutting elements 31. The gage row of cutting elements 31 functions to cut the borehole sidewall, borehole corner, and borehole bottom. An adjacent row of cutting elements 32, located immediately laterally interior of the gage row of cutting elements 31 is known as a "staggered" row because the adjacent row cutting elements 32 are not directly azimuthally aligned with and are spaced between the gage row cutting elements 31 as to their positions about the circumference of the roller cone 30. Further, as shown in FIG. 3A, the immediately interior (adjacent) row cutting elements 32 partially overlap the gage row cutting elements 31 in cross section profile. Thus, the immediately interior row of cutting elements has a cutting element count that is dependent on the gage row count.

Second interior row cutting elements 33, and third interior row cutting elements 34 on the roller cone shown in FIG. 3A are generally (azimuthally) rotationally aligned independently of the gage row cutting elements 31 and, thus are described as being non-staggered.

Prior art roller cone drill bits typically included staggered rows of cutting elements similar to the ones shown in FIG. 3A on only one or two of the roller cones. More specifically, for drill bits in which the cutting elements are tungsten carbide inserts, the structure of typical prior art bits can be categorized as follows. The drilling industry categorizes roller cone drill bits according to the types of earth formations which the bit is particularly designed to drill efficiently. One such categorization is known as the IADC (International Association of Drilling Contractors) Class of the bit. Examples of drill bits classified in certain IADC classes are shown in FIG. 3B. Drill bits classified in IADC series 5, 6, 7 and 8 in the prior art only included staggered rows on two of the three roller cones.

Another type of prior art drill bit using tungsten carbide inserts is shown in FIG. 4. Typically, as the formations for which the bit is designed become progressively harder, the cutting elements become relatively shorter with respect to their extension length from the surface of the roller cone. Cutting element extension length to diameter ratios for bits in the previously described IADC series 5, 6, 7 and 8 are shown as clusters of points for each such bit in each series.

Some bits, for example as shown at 41, 42, 43 and 44 in FIG. 4, have insert extension length to diameter ratios which exceed about 0.829. All of these bits in the prior art have a staggered row of cutting elements on only one roller cone.

One reason that prior art bits included only one or two cones having staggered rows is that it was generally believed that the number of cutting elements in the gage rows needed to be kept relatively high to increase durability, so that the bit would drill a substantially gage hole for a long as possible during the useful life of the bit. The geometry of the bits necessitated having only one or two cones with staggered rows of cutting elements in order to maximize to the greatest extent possible the cutting element count in the gage rows. Having bits with only one or two cones with staggered rows of cutting elements can reduce the effective life and drilling performance of such drill bits.

SUMMARY OF THE INVENTION

One aspect of the invention is a roller cone drill bit including a bit body having three legs depending therefrom, each leg having a journal on it. A roller cone is rotatably mounted on each journal, and each roller cone has a plurality of cutting elements on it. The cutting elements are arranged in rows on each roller cone. The rows of cutting elements include at least a gage row and a first row interior of the gage row. The first interior row is staggered with respect to the gage row on each one of the three cones. In one embodiment, the cutting elements are tungsten carbide inserts.

In another embodiment, a maximum distance between the cutting elements on the gage row and the first interior row on any one of the cones is about zero to 350 percent greater than a minimum distance between the cutting elements on the gage row and the first interior row on any other one of the cones. In another embodiment, an area of the hole bottom surface cut by the cutting elements on the gage row and the first interior row on the three roller cones is between about 20 and 60 percent of a total area of the hole bottom cut by all the cutting elements on all the roller cones.

Another aspect of the invention is a roller cone drill bit including a bit body having three legs depending therefrom. Each leg has a journal, a roller cone rotatably mounted on each journal, and each roller cone has a plurality of cutting elements thereon. The cutting elements are arranged in rows on each cone. The rows include at least a gage row and a first row interior of the gage row. The first interior row is staggered with respect to the gage row on at least two of the three cones. The cutting elements have an extension to diameter ratio of at least 0.829.

In one embodiment, a maximum distance between the cutting elements on the gage row and the first interior row on any one of the at least two cones is about zero to 350 percent greater than a minimum distance between the cutting elements on the gage row and the first interior row on any other one of the at least two cones. In another embodiment, an area of a hole bottom surface cut by the cutting elements on the gage row and the first interior row on the three roller cones is between about 20 and 60 percent of a total area of the hole bottom cut by all the cutting elements on all the roller cones.

Another aspect of the invention is a structure for a roller cone drill bit. The bit includes a bit body having three legs depending therefrom, each leg having thereon a journal, a roller cone rotatably mounted on each journal, and each roller cone has a plurality of cutting elements thereon. The cutting elements are arranged in rows on each cone, the rows including at least a gage row and a first row interior of the gage row. A fractional amount of a hole bottom area defined by the cutting elements in the gage row and the first interior row is less than a boundary amount defined with respect to a cutting element extension to diameter ratio, the boundary amount substantially conforming to values of the ratio 0.330, 0.436, 0.49, 0.52, 0.56, 0.592 0.658, 0.688, 0.747, 0.769, 0.8, 0.875, 1.04 and corresponding fractional amounts of 42.30, 36.44, 48.32, 50.67, 50.65, 45.3, 51.80, 49.53, 54.45, 58.08, 60.88, 61.81, and 65.57 percent.

Other aspects and advantages of the invention will be apparent from the following description and the appended claims.

BRIEF DESCRIPTION OF THE DRAWINGS

FIG. 3B shows an IADC bit classification chart.

FIG. 12 shows a table of coordinate values for boundary endpoints in the graph of FIG. 11.

DETAILED DESCRIPTION

Figure 1:
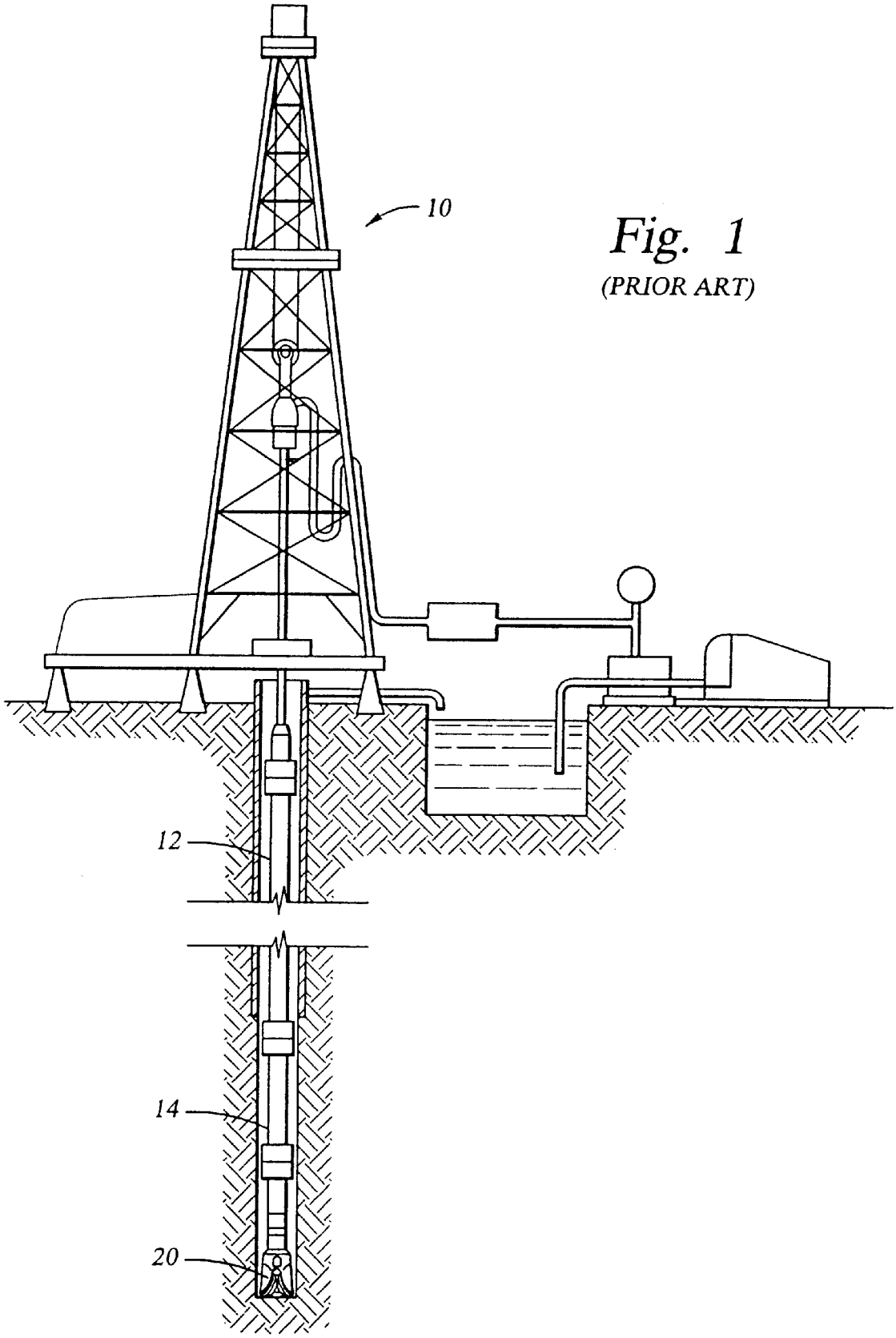
Fig. 1 (PRIOR ART)
FIG. 1 shows a prior art drilling system using a roller cone drill bit.
Figure 2:
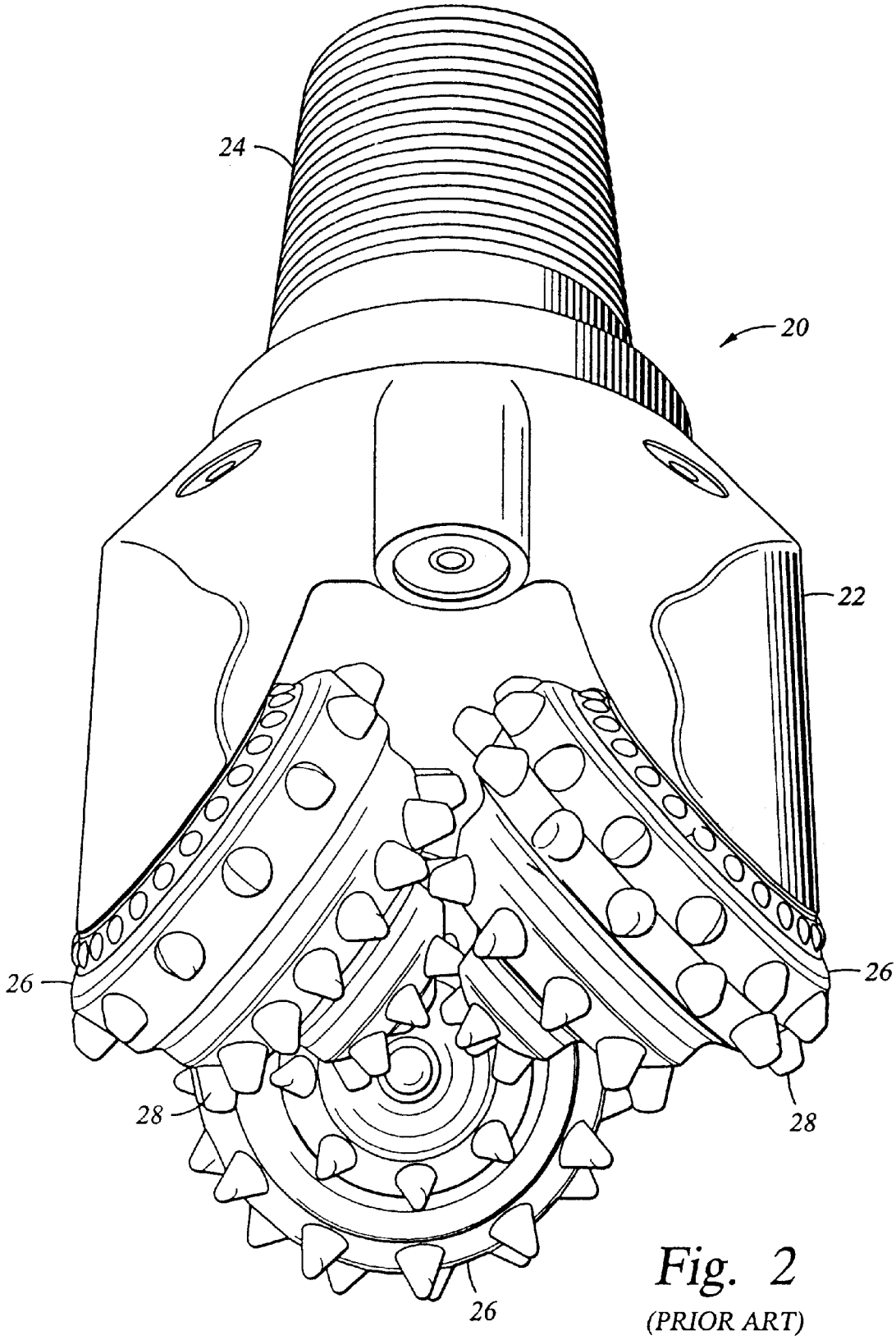
Fig. 2 (PRIOR ART)
FIG. 2 shows a typical prior art roller cone drill bit structure.
Figure 3A:
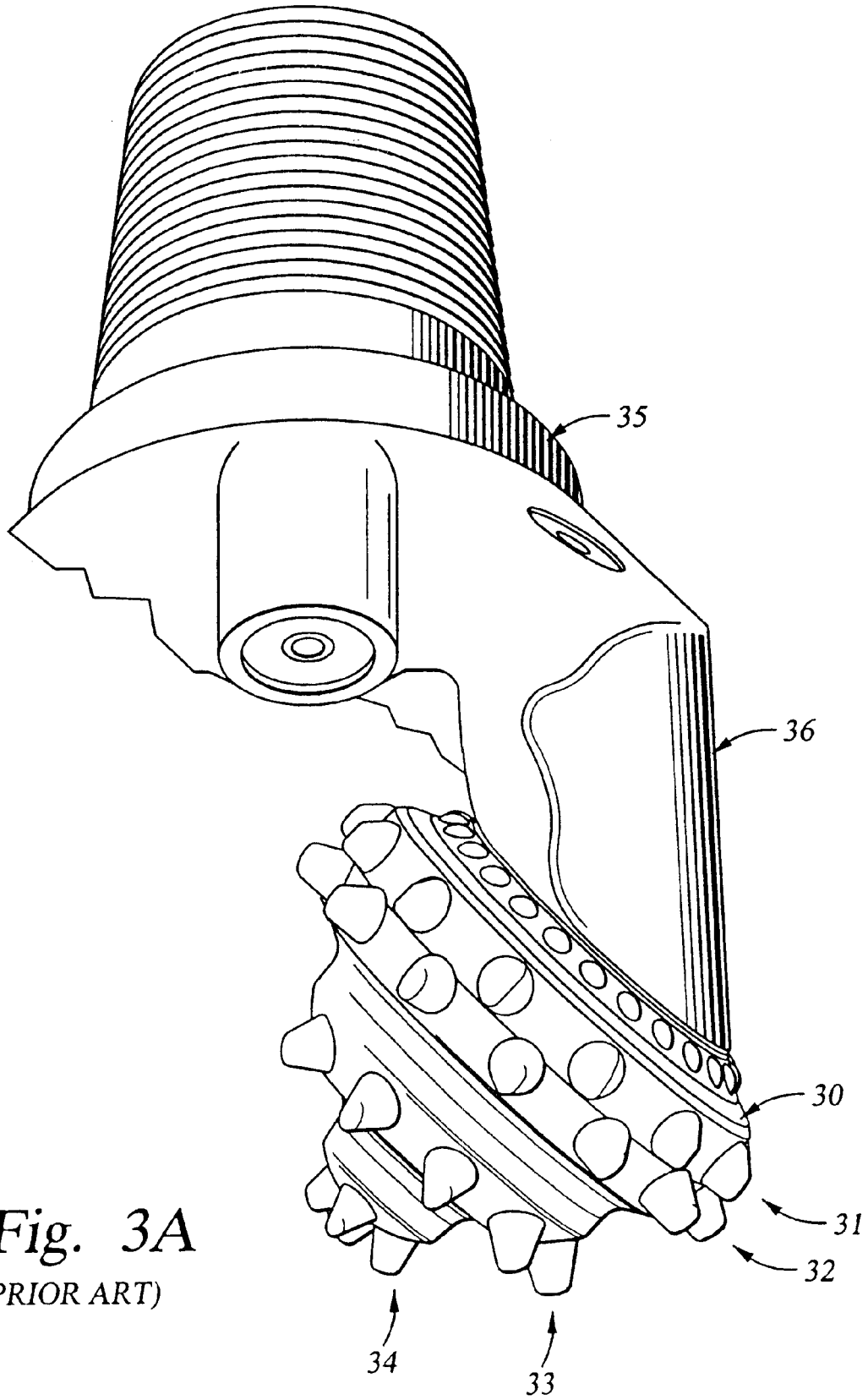
Fig. 3A (PRIOR ART)
FIG. 3A shows a typical prior art staggered cutting element bit structure.
Figure 4:
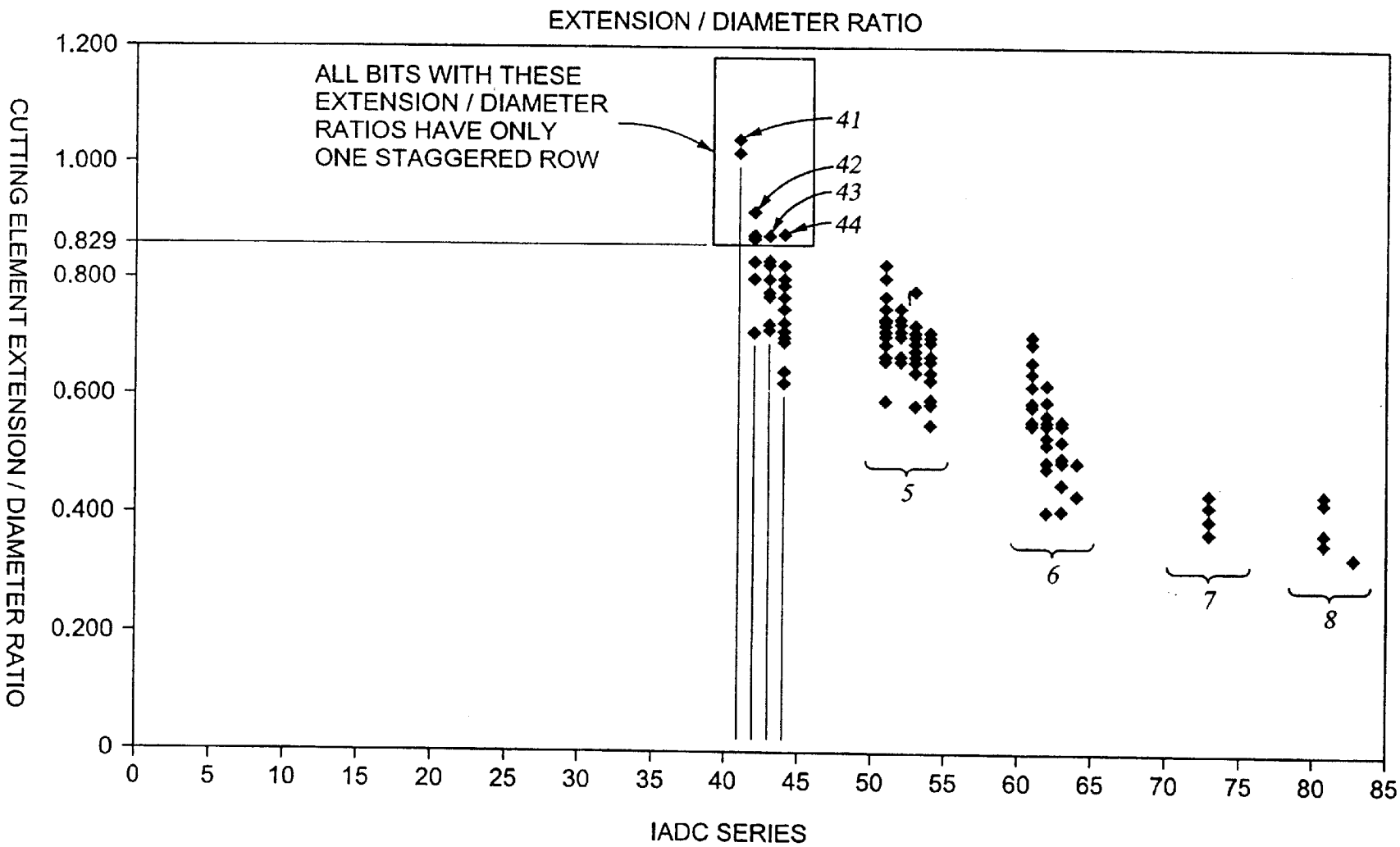
FIG. 4 shows a graph of cutting element extension length to diameter ratio for bits in IADC series 4, 5, 6, 7, and 8.
Figure 5:
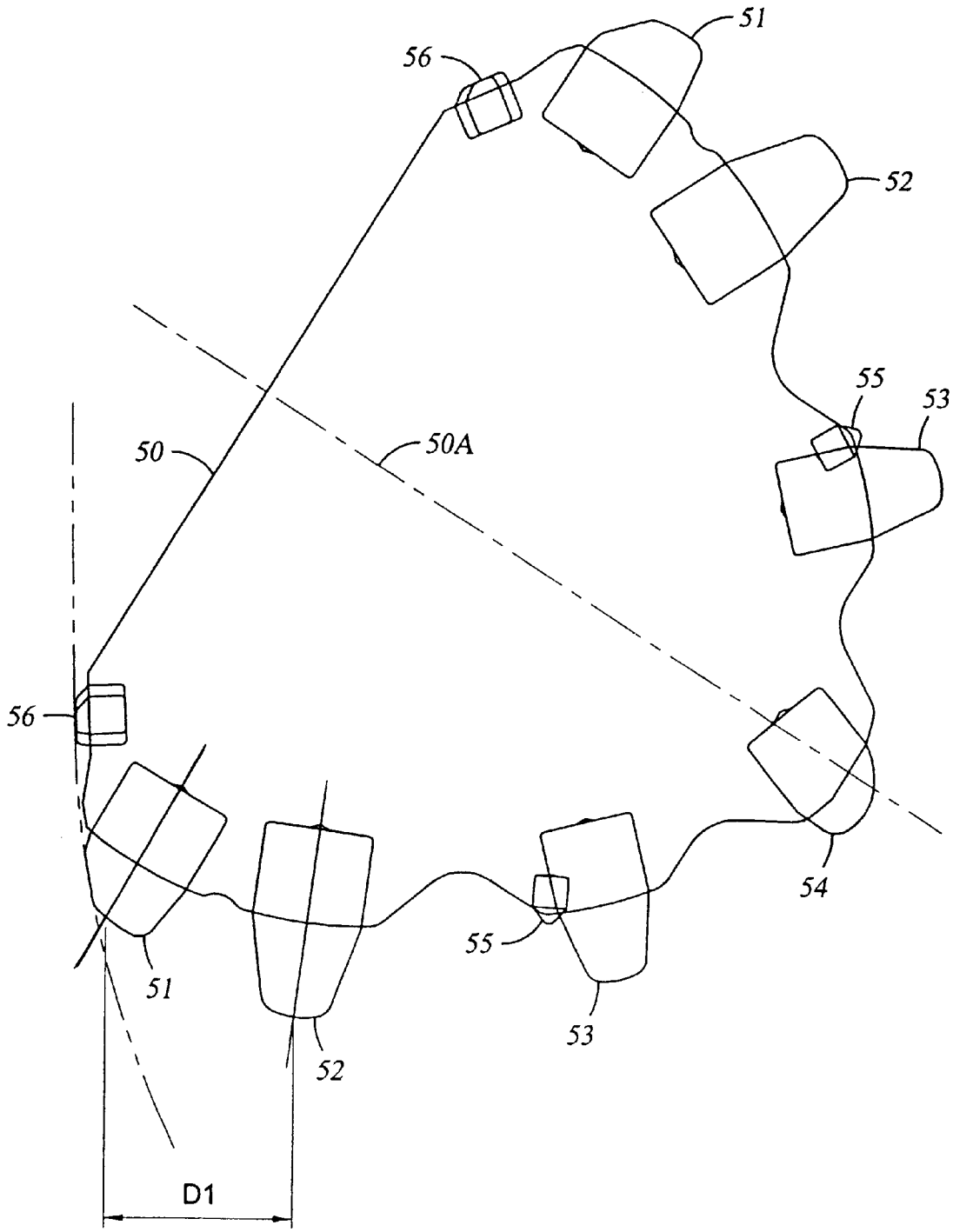
FIGS. 5, 6 and 7 show cross section (profile) view respectively, of each of the three roller cones on a three cone bit according to one aspect of the invention.

An embodiment of one aspect of the invention is shown in a cross-section or "profile" view of each of three roller cones (shown in FIGS. 5, 6, and 8) on a roller cone drill bit. In general configuration, a bit according to this aspect of the invention is similar to the prior art drill bit shown in FIG. 2. It is the location and distribution of cutting elements on each of the roller cones which distinguishes the invention from the prior art. Referring first to FIG. 5, a first roller cone includes a cone body 50 made from steel or other material known in the art. The cone body 50 has disposed about its surface a plurality of cutting elements. In this embodiment, the cutting elements are tungsten carbide inserts of any type known in the art. The inserts are designed and arranged so that the bit resulting therefrom will be classified generally in IADC (International Association of Drilling Contractors) series 4 type 1 or 2 (IADC Class 41 and 42).

The cutting elements are arranged in rows about the surface of the cone. Each such row is generally defined by having all of the cutting elements in the row be located at a selected lateral distance from the axis 50A of the cone body 50. A maximum lateral distance between the cutting elements on the row and the axis of the drill bit (not shown in FIG. 5) will depend on the diameter of the cone and the drill diameter of the bit. The rows defined in FIG. 5 include a "gage row". One cutting element of the gage row is shown at 51, The rows further include a first row interior to the gage row, one cutting element of which is shown at 52, a second interior row, at 53, and a centrally located cutting element at 54. A roller cone such as shown in FIG. 5 can also include a "heel row" of small cutting elements disposed such as shown at 56. Heel row cutting elements help maintain the gage diameter of the wellbore drilled by the bit. Additionally, the cone may include "ridge row" cutting elements, such as shown at 55, to break up ridges of formation which protrude between rows of cutting elements on the cones. Ridge row cutting elements generally do not have a material effect on the axial force acting on each roller cone and are arranged dependently to the other cutting elements arranged according to the various aspects of this invention.

The cone shown in FIG. 5 does not include a "staggered row" of cutting elements proximate to the gage row 51. Therefore, the position about the circumference of each cutting element in any row interior of the gage row 51, such as first interior row 52, and second interior row 53 may correspond to the azimuthal (rotary) position of each cutting element in the gage row 51, or may be displaced therefrom by a fractional pitch (circumferential distance between each cutting element on any one row).

Figure 6:
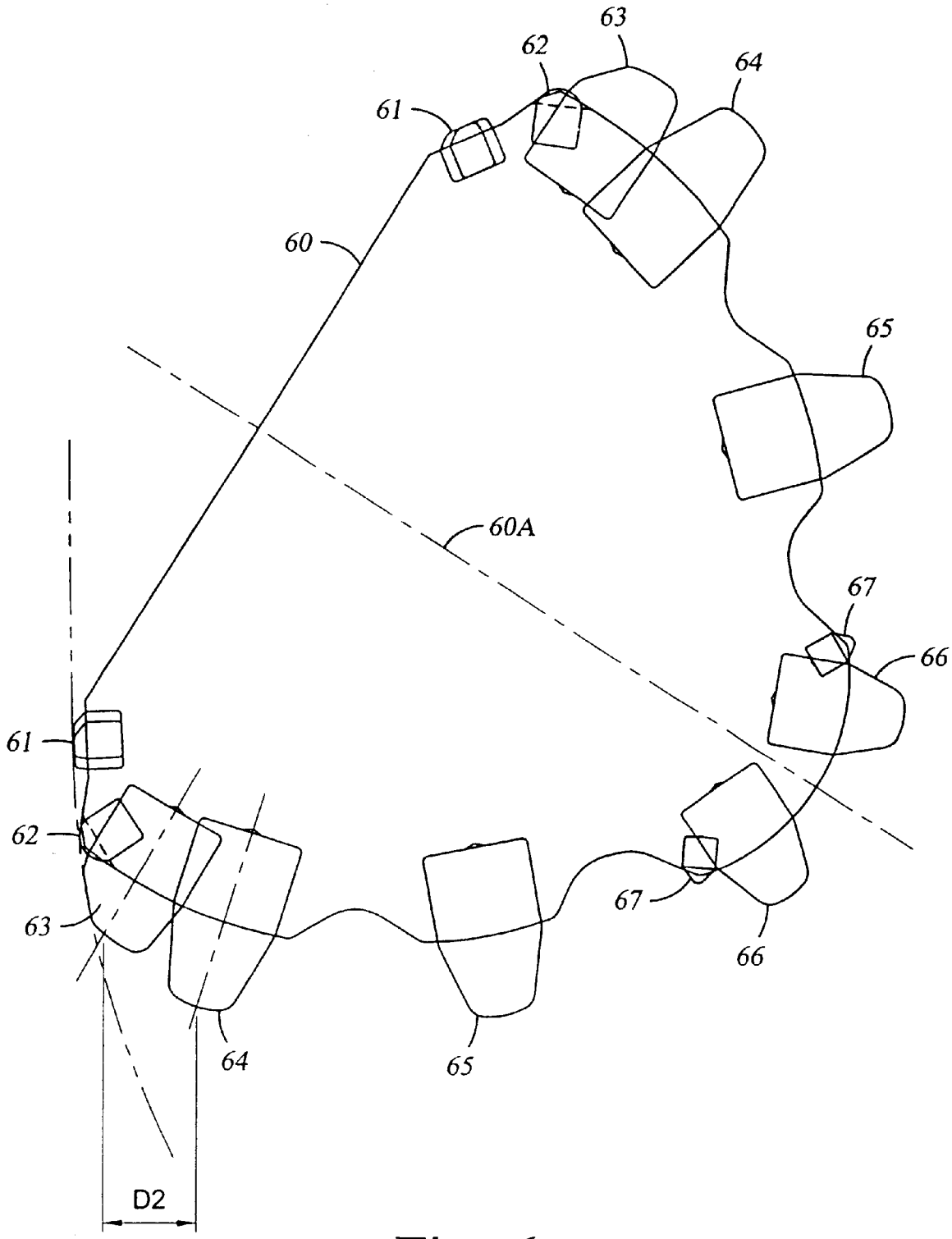

In this aspect of the invention, the cutting element extension (protrusion length outward from the cone body surface) to diameter ratio is about 0.875. This exceeds a ratio value of 0.829. This ratio is generally defined with respect to the cutting element with the largest extension. This is the predominant extension generally used on any of the interior rows of cutting elements. The cutting element having the largest extension may also be located on the first or second interior row. Recall from the Background section herein that prior art drill bits having cutting element extension to diameter ratio above about 0.829 typically had only one roller cone with a staggered row of cutting elements. In this aspect of the invention, at least two of the roller cones on a bit having such a cutting element extension to diameter ratio (0.829 or greater) will have a staggered row of cutting elements. An example of such a roller cone is shown in FIG. 6. This cone has a body 60 similar to that shown in FIG. 5, and includes a gage row of cutting elements 63. The cone body may include a heel row 61, and a nestled row 62 such as on the cone in FIG. 5. The cone body 60 includes a first interior row of cutting elements 64, and a second 65 and a third 66 interior row of cutting elements. This cone may also include ridge row cutting elements 67 just as for the first cone (in FIG. 5). It can be observed in FIG. 6 that the cutting elements on the first interior row 64 are laterally positioned, with respect to the axis 60A such that some of their projected cross section overlaps the projected cross section of the cutting elements in the gage row 63. Because of this overlap, it is necessary that the azimuthal (rotary) position of the first interior row of cutting elements 64 be spaced at least a fractional pitch from rotary (azimuthal) alignment with the position of the gage row cutting elements 63. The overlap can occur only at the top extending portions of the cutting elements, only at the bottom portions, or both.

Figure 7:
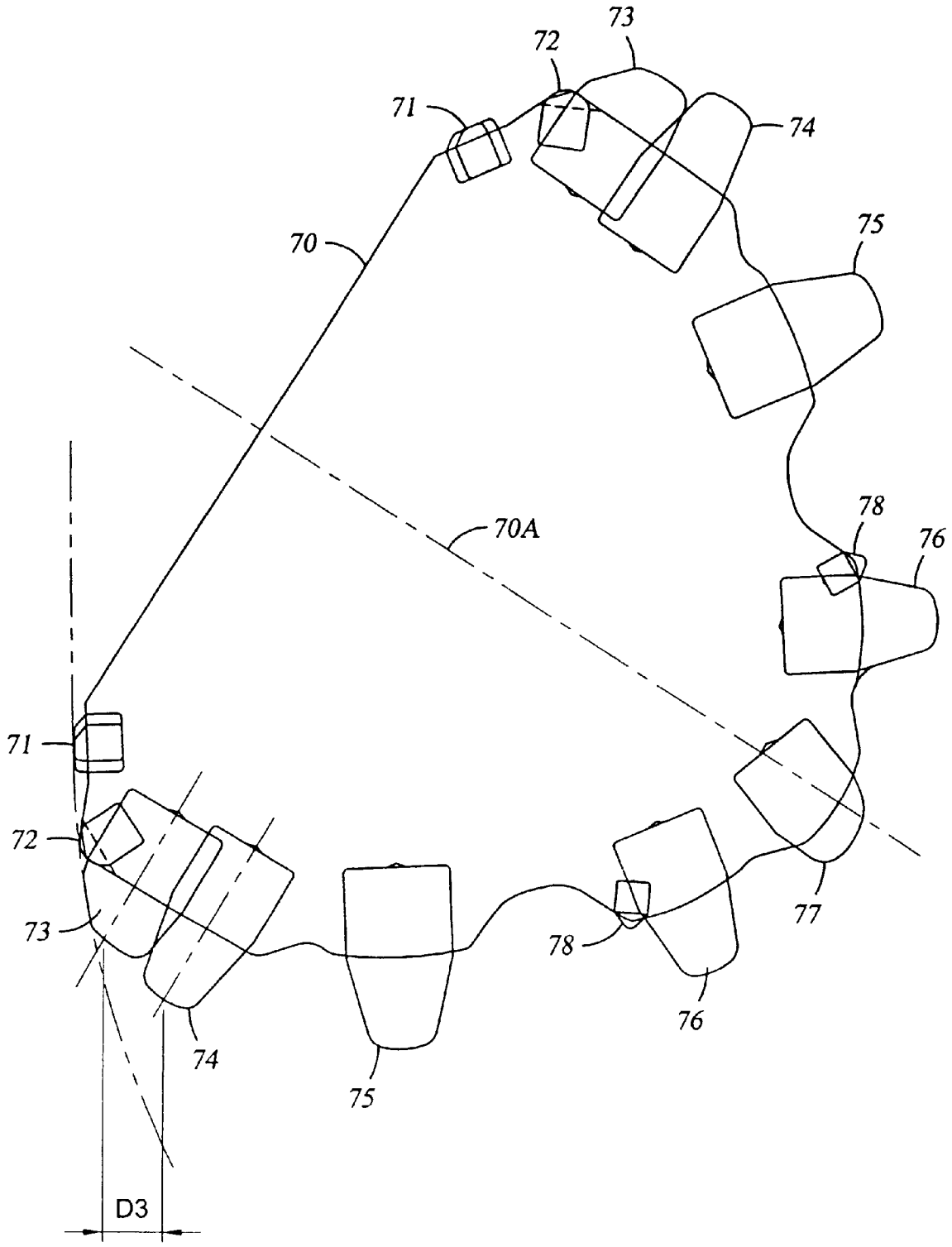

A similar configuration is shown in FIG. 7 for the third cone, which in this aspect of the invention is also configured to have a "staggered row" of cutting elements. The third cone includes a cone body 70 having gage row 73, first interior row 74, second interior row 75 and third interior row 76 cutting elements. A center cutting element 77 can be positioned to cut formation at the center of the wellbore, and should be positioned and have a size selected to avoid interference with the corresponding cutting element on the first cone (54 in FIG. 5). The third cone may include a heel row 71, a nestled row 72, and ridge row cutting elements 78. As is the case for the other two cones, the cutting elements on the third cone in this embodiment are tungsten carbide inserts having an extension diameter ratio of about 0.875.

In this embodiment of a drill bit made according to the present aspect of the invention, a distance can be defined between the apex of the cutting elements on each gage row (51 in FIG. 5, 63 in FIG. 6 and 73 in FIG. 7) and the apex of the cutting elements on the first interior row on each cone, the distance being measured between lines parallel to the axis of the hole drilled by the bit. The apex of the cutting elements can be defined as the intersection of the axis of the extended portion of the cutting element and the crest. These distances are shown at D1, D2 and D3 in FIGS. 5, 6 and 7, respectively. In this embodiment, the largest one of the distances, in this example D1 in FIG. 5, can be within a range of about 0 to 350 percent greater than the smallest one of the distances, shown as D3 in FIG. 7 in this example. More preferably, the maximum distance D1 is about 100 to 250 percent greater than the smallest distance D3.

Figures 7A, 7B:
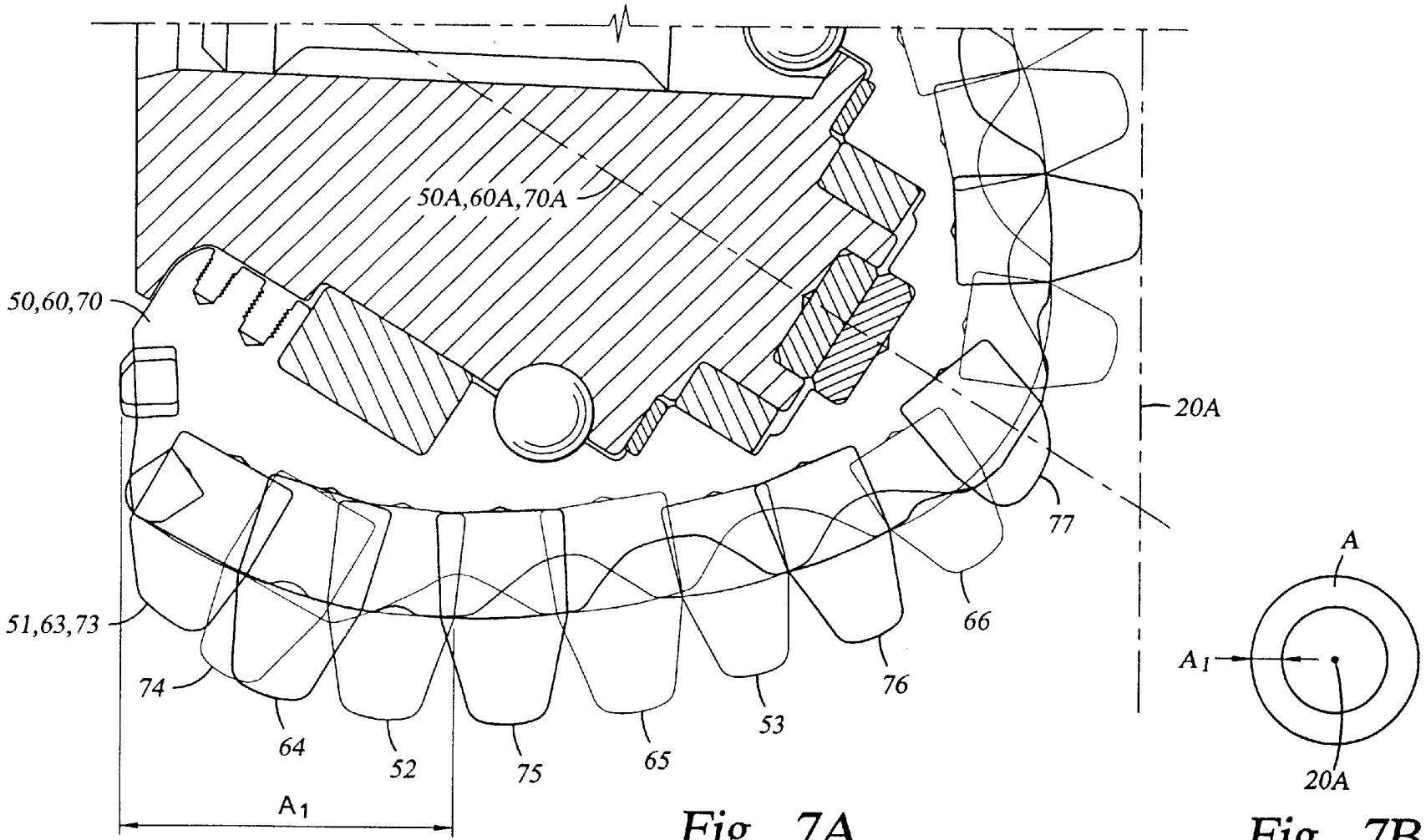
FIG. 7A shows a profile view of the roller cones of FIGS. 5, 6, and 7, with all the cutting elements rolled into a single plane.
FIG. 7B shows an example of bottom hole area cut by the cutting elements on the gage and first interior rows.

FIG. 7A, shows the cones of FIGS. 5, 6, and 7 rolled into a single plane. A bottom hole coverage area A (shown in FIG. 7B which is a view looking down bit axis 20A) is defined as the aggregate area projected along the bottom of a hole drilled by the bit, which is covered by the cutting elements located between the gage row and the corresponding first interior row of cutting elements on each of the cones. The bottom hole coverage area A can be calculated by using distance A1 (shown in FIG. 7A), which is measured from the inner end (intersection of the cutting element and the cone) of the cutting elements on the first interior row on the cone that has the largest distance from the gage row to the bit diameter. In some embodiments, area A can be about 20 to 60 percent of the total area of all the cutting elements on all the cones (nominally the total area of the bottom hole surface drilled by the bit). More preferably, area A, of the elements on the gage rows and first interior rows, is between about 40 to 60 percent of the total hole coverage area of all the cutting elements. In this embodiment of the invention, the distances and arrangement of cutting elements on the cones should be selected to provide the preferred ranges of coverage area for the respective cutting elements. It has been determined that having cutting elements arranged in this manner according to this aspect of the invention results in more balanced axial force (relative to the bit centerline) between each of the roller cones, and more balanced distribution of force on each of the roller cones. Such balancing of forces may improve rate of penetration of the drill bit, and may improve the expected useful life of the drill bit.

In this aspect of the invention, as well as in other aspects of the invention which will be explained below, in order to provide the staggered row of cutting elements on at least two cones it may be required to reduce the number of cutting elements on the corresponding gage rows to enable the cutting elements on the various cones to fit in the available space. It has been determined that reducing the number of gage row cutting elements to enable fit of the staggered row cutting elements does not significantly reduce the capacity of the bit to drill a full gage diameter hole during the entire useful life of the bit. It has also been determined that the prior art design practice actually decreases the gage row durability on the cone(s) without a staggered row, and creates a load imbalance between cones. In prior art bits, the gage row and its adjacent non-staggered row may have higher peak forces, because the large distance between them prevents the load from being shared effectively. Also, the total axial cone force is lower on the cone with the non-staggered row that has large distance from the gage row. This can create a load imbalance with respect to the other cones.

Prior art roller cone bits typically had a relatively large number of cutting elements disposed on the gage rows, as it was believed that this configuration would best maintain gage drilling throughout the life of the bit. In the various embodiments of the invention, this has been shown to be unnecessary.

Figure 8:
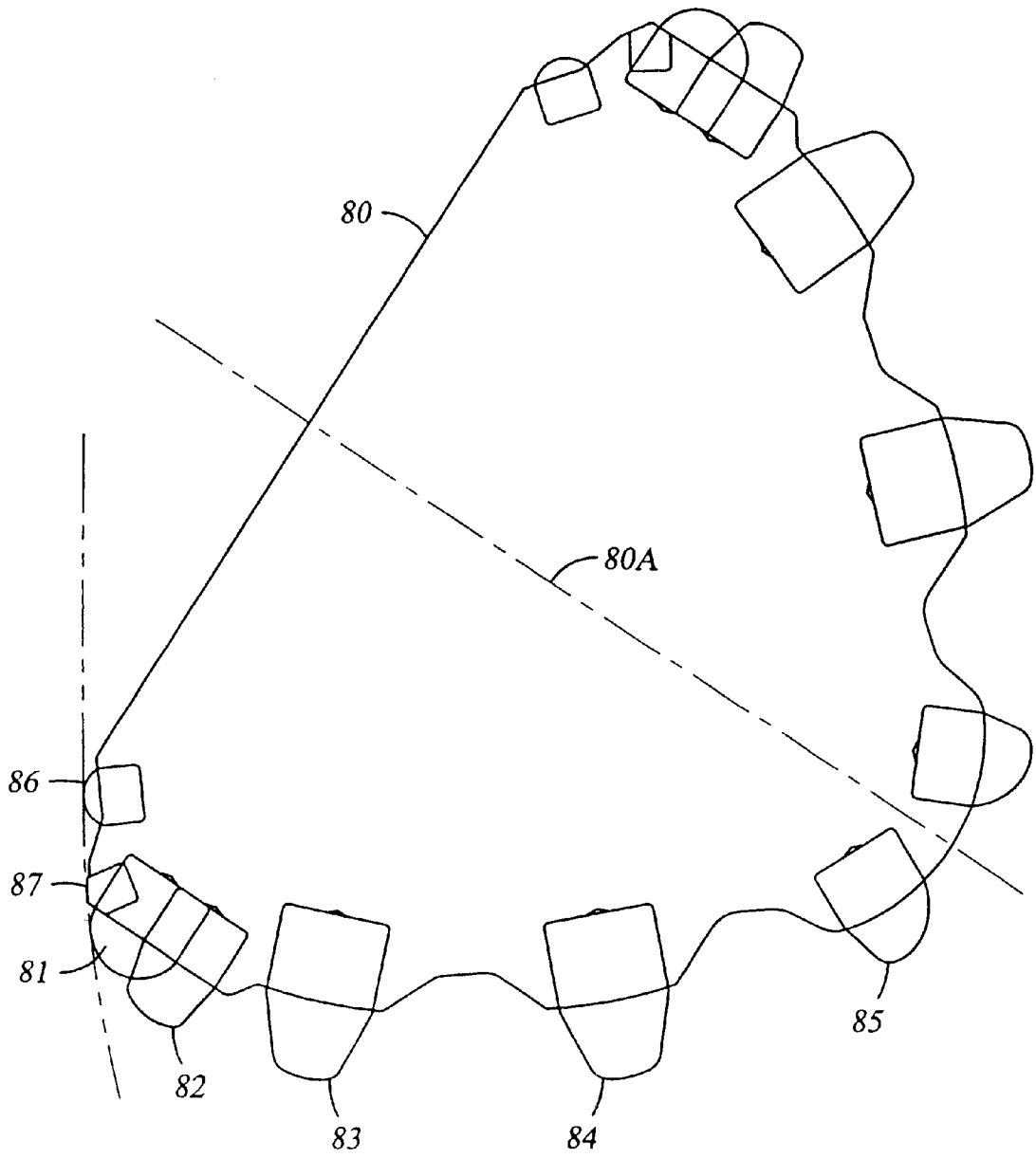
FIGS. 8, 9 and 10 show cross section (profile) views, respectively, of each of the three roller cones on a three cone bit according to another aspect of the invention.
Figure 9:
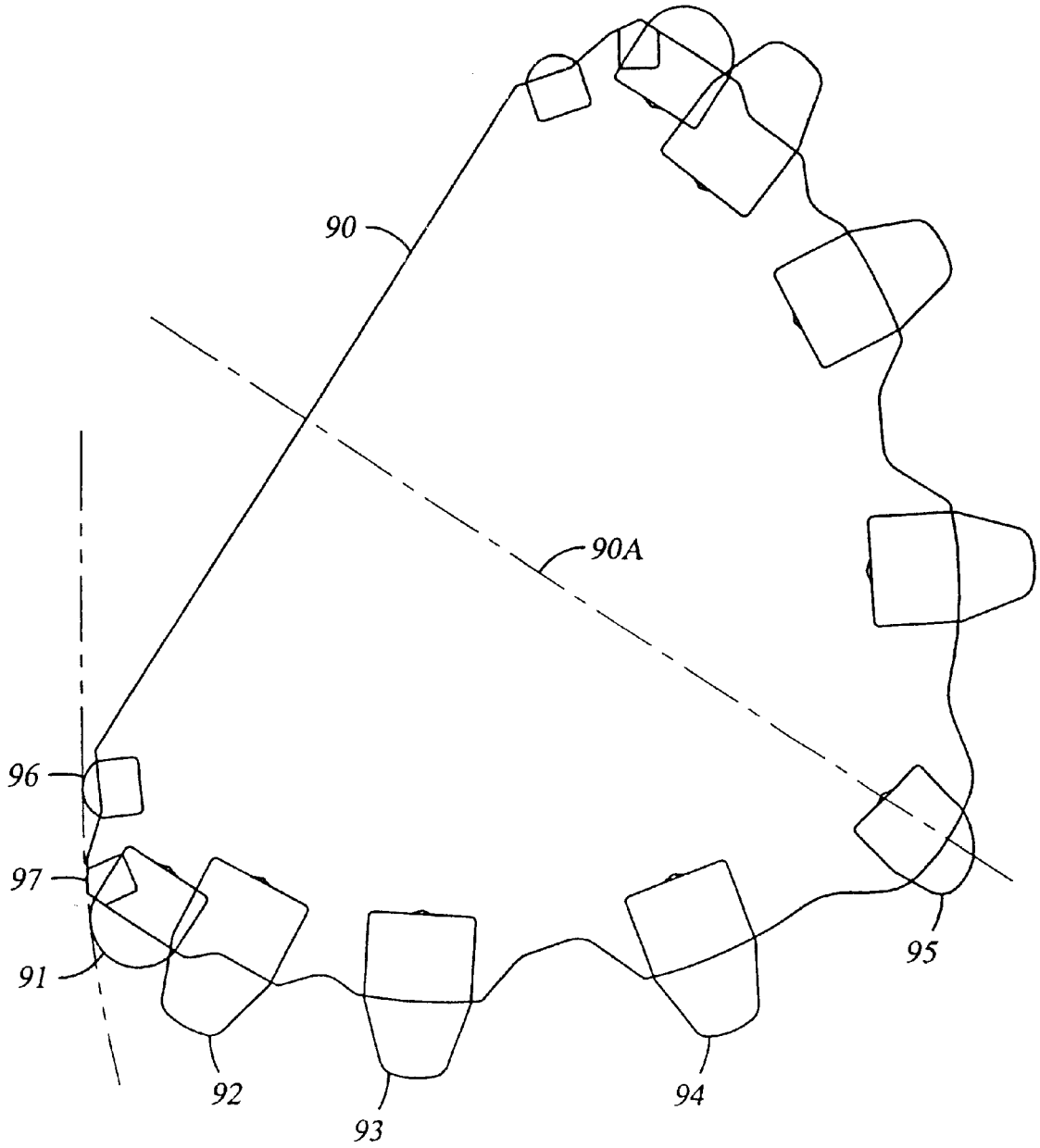
Figure 10:
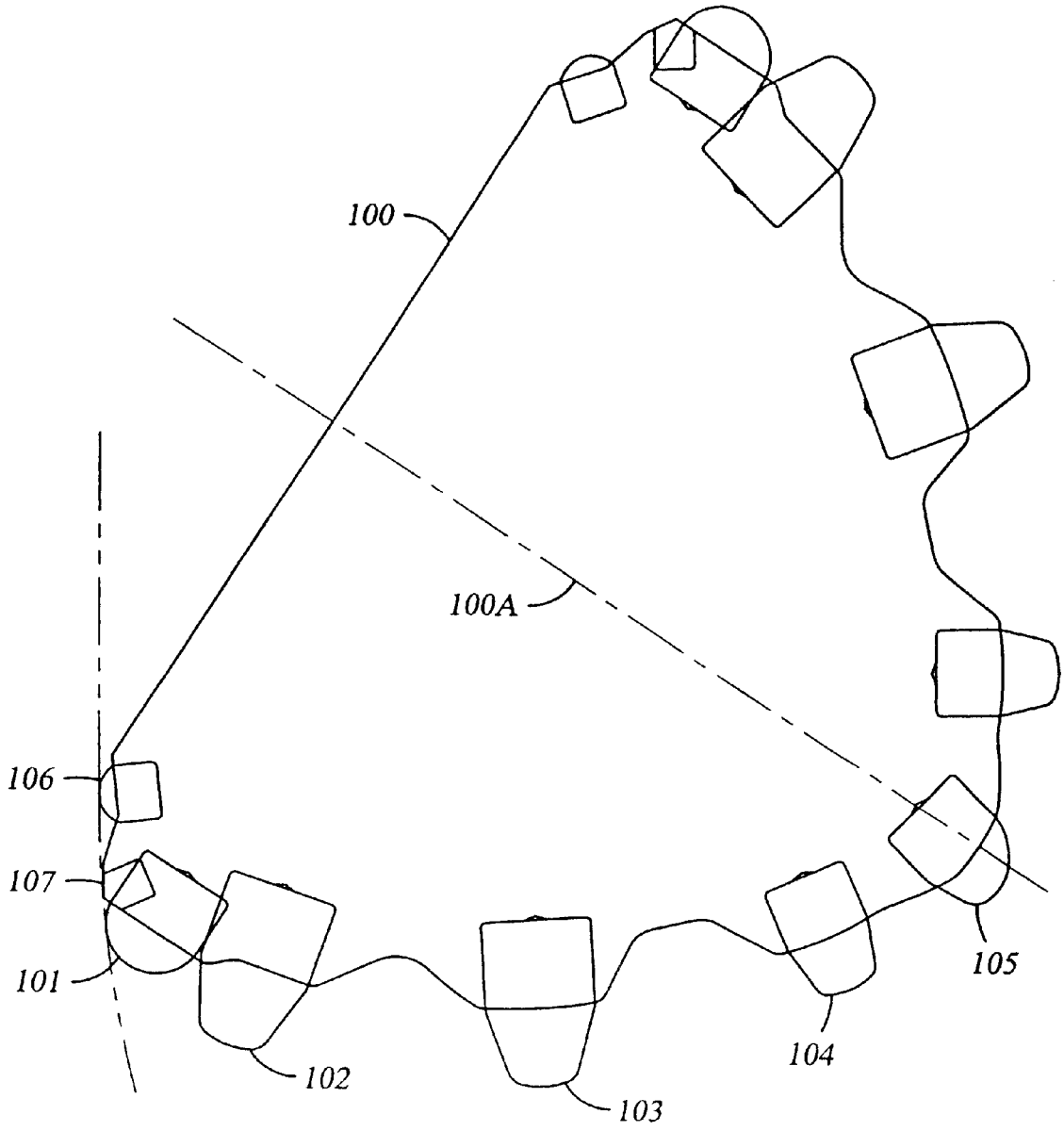

In another aspect of the invention, the cutting element extension to diameter ratio may be less than about 0.829. This is typically the case for bits used to drill harder formations. In this aspect of the invention, all three roller cones may have staggered rows of cutting elements. Examples of cones on a drill bit according to this aspect of the invention are shown in FIGS. 8, 9 and 10. The cone in FIG. 8 includes a cone body 80 that is symmetric about its axis 80A and includes thereon a gage row 81, first interior row 82 which is staggered as previously defined herein, a second 83, third 84 and fourth 85 interior row of cutting elements. The cone may also include heel row 86, and nestled row 87.

A similar structure is shown for the cone body 90 in FIG. 9, which includes a gage row 91, and a staggered first interior row 92. The cone in FIG. 9 includes a center cutting element 95 near the axis 90A, and so includes only second 93 and third 94 interior rows of cutting elements. The second cone may also include heel row 96, and nestled row 97.

As shown in FIG. 10, the third cone in a bit according to this aspect of the invention can include a cone body 100 which rotates about its axis 100A, a gage row 101 and staggered first row 101 of cutting elements, and a second 103 and third 104 interior row of cutting elements. This cone may also include a center cutting element 105. The cutting elements on the cones are disposed so as not to interfere with each other during rotation of the cones. In this aspect of the invention, distances can be defined in the same manner as in the previous aspect of the invention. In one embodiment according to this aspect of the invention, the largest distance between the gage row apex and the first interior row apex can be 0 to 350 percent greater than the smallest corresponding distance. More preferably, the maximum distance is about 100 to 250 percent greater than the smallest distance. Drill bits made according to this aspect of the invention can generally be characterized according to any one of IADC series 4, 5, 6, 7 and 8.

In an embodiment of a drill bit made according to this aspect of the invention, the bottom hole coverage area (A in FIG. 7B) of the gage rows and first interior rows (as defined previously in the description relating to FIG. 7B) is between about 20 and 60 percent of the total bottom hole coverage of all the cutting elements on the three cones. More preferably, the bottom hole coverage area A of the gage rows and first interior rows is between 30 and 40 percent of the total bottom hole area. As in the previous aspect of the invention and it various embodiments, the arrangement of the cutting elements according to the present aspect and its various embodiments provides better balance and distribution of cutting forces between and on each of the roller cones. Such bits can provide greater penetration rates and can have longer life than corresponding prior art bits.

In some embodiments of a drill bit made according to either of these aspects of the invention, the extension to diameter ratio, and a corresponding fractional amount of the bottom hole area coverage (A in FIG. 7B) for the gage and first interior rows of cutting elements can fall within the following selected ranges:

| Extension to diameter ratio | Bottom hole coverage areea |
|---|---|
| >.799 | 20 to 60 |
| .799 to .709 | 20 to 53 |
| .710 to .440 | 20 to 43 |
| <.440 | 20 to 35 |

More preferred ranges are as follows:

| Extension to diameter ratio | Bottom hole coverage area |
|---|---|
| >.799 | 30 to 55 |
| .799 to .709 | 20 to 45 |
| .710 to .440 | 20 to 33 |
| <.440 | 10 to 25 |

Figure 11:
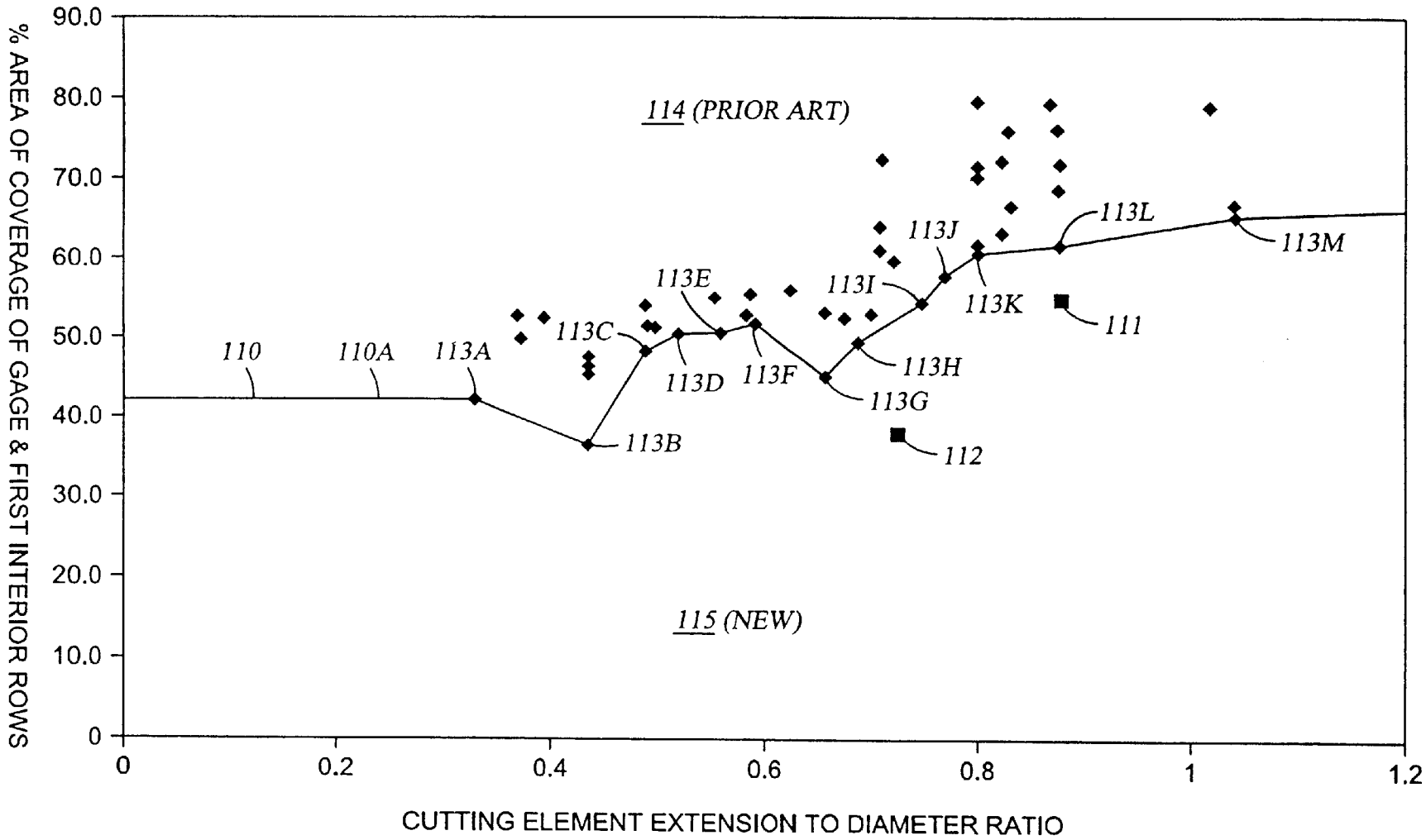
FIG. 11 shows a graph of bottom hole coverage area for selected cutting elements with respect to extension to diameter ratio for prior art bits and bits according to one aspect of the invention.

FIG. 11 shows in graphic form another aspect of the invention. FIG. 11 shows for various bits the bottom hole coverage area (A in FIG. 7B) of the gage and first interior rows with respect to the extension to diameter ratio. Line 110 in FIG. 11 defines a boundary 110A between prior art bits, and bits which fall within the scope of this aspect of the invention. The boundary 110A separates two regions, upper region 114 and lower region 115. Upper region 114 contains points representing prior art bits, and lower region 115 defines the scope of the invention. Any point within the lower region 115 is considered to be within the scope of the invention. Points corresponding to extension to diameter ratio and corresponding bottom hole coverage area for the example bit shown in FIGS. 5, 6, and 7, and for the example bit shown in FIGS. 7, 8, and 9, are shown at 111 and 112, respectively. These points 111, 112 fall below the boundary 110A, in the lower region 115. Line 110, which defines the boundary 10A, is defined by endpoints 113A–113M The coordinate and ordinate values of these endpoints 113A–113ML are shown in the table of FIG. 12. Values of coverage area which correspond to values of the cutting element extension to diameter ratio that are intermediate to the endpoints 113A–113M are shown as being along line 110 in FIG. 11, but it should be clearly understood that other suitable methods for interpolating these intermediate values can be used. Examples of other interpolation include polynomial curve fit or the like. Accordingly, line 110 represents only one type of boundary characterization between the lower region 115 of the invention, and the upper region 114 defining the prior art.

In some embodiments according to this aspect of the invention, the corresponding ordinate value of the boundary 110A can be can be offset (reduced), at each value of extension to diameter ratio, by a 5 to 30 percent reduction of the bottom hole coverage area shown in the table of FIG. 12. More preferably, the reduction range is 10 to 10 percent. It has been found through numerical simulation and actual tests of bits made according to this aspect of the invention that bits having bottom hole coverage area below the boundary 110A for any cutting element extension to diameter ratio have greater gage durability and a more balanced axial load between the cones.

Figure 13:
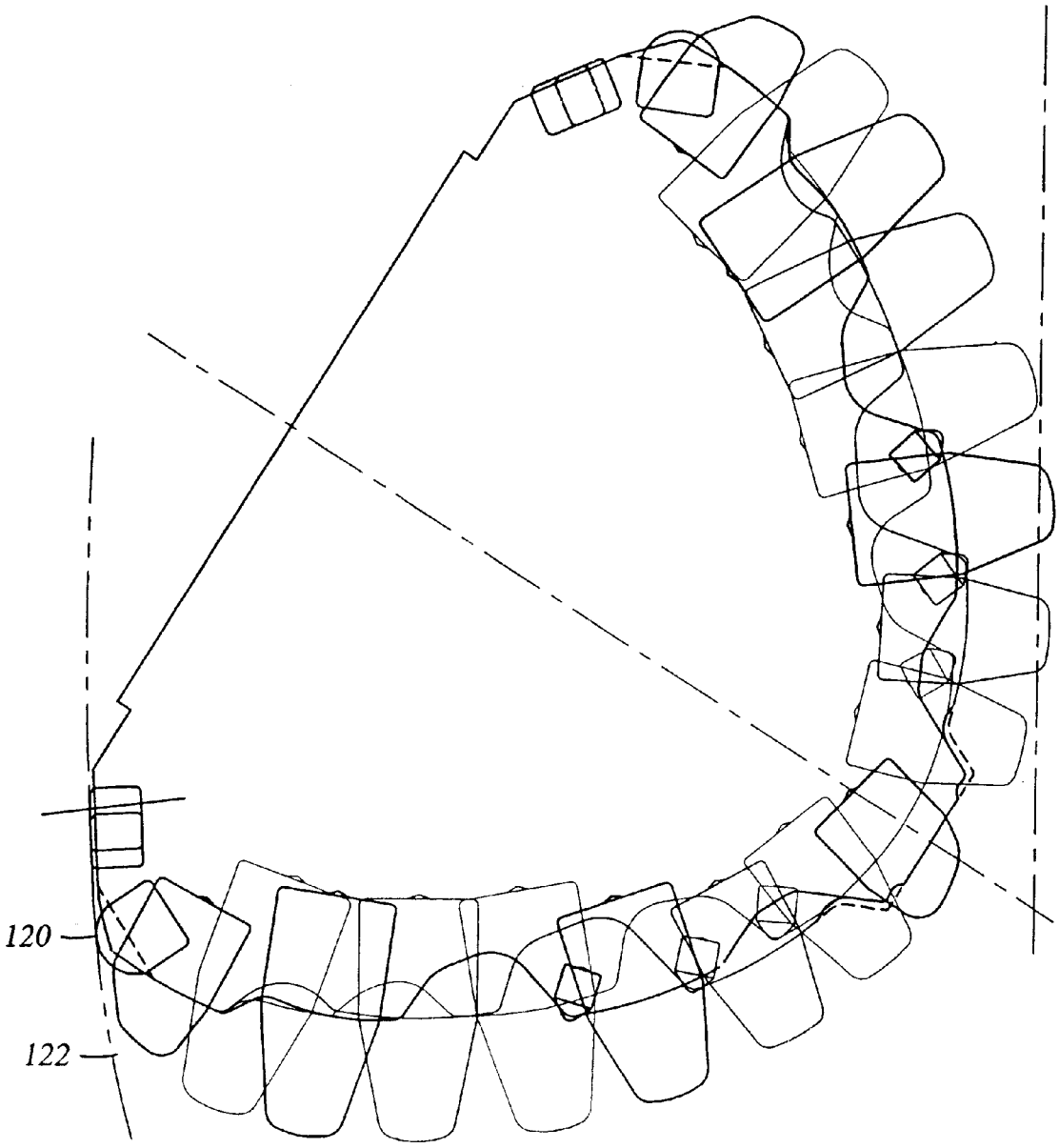
FIG. 13 shows a profile view, rolled into one plane, of the cones on a bit having "off gage" cutting elements.

All of the aspects and the various embodiments thereof described for the invention can be applied to bits with "off-gage" cutting elements such as described in co-pending U.S. patent application Ser. No. 08/630,517, assigned to the assignee of the present invention. Referring to FIG. 13, cutting elements 120 defined as "gage" cutting elements primarily cut the borehole side wall, but do not substantially cut the hole bottom, as distinguished from the gage row cutting elements such as shown at 51, 63 and 73 in FIGS. 5, 6 and 7, respectively. "Off-gage" cutting elements 122 primarily cut the borehole bottom and borehole corner. Because the gage cutting elements 120 do not primarily cut the borehole bottom, the axial load on them is typically very low. Therefore the forces on the gage cutting elements 120 do not substantially contribute to balancing the axial load between the cones. The off-gage cutter elements 122, however, primarily cut the borehole bottom and borehole comer, and therefore substantially contribute to balancing the axial load between the cones and distributing the load between the first inner row. Thus, off-gage cutting elements 122 are considered to act in the same manner, as the gage cutting elements referenced in the various embodiments of the present invention.

Because of space constraints with the adjacent intermeshing cones, some or all of the cutting elements on the first interior row on all the embodiments described herein can have a different diameter and extension than those on the second or third interior row. The cutting element diameter of any one or more of the cutting elements on the first interior row can be the same diameter or smaller, than the diameter of the cutting elements used on the second and/or third interior rows. More preferably, the at least one smaller cutting element is at most 50% smaller in diameter than the other cutting elements. The cutting element extension of any one or more of the cutting elements on the first interior row can be the same or smaller than that of the cutting element on the gage, second or third interior rows. More preferably, the at least one smaller extension cutting element is at most 20% shorter extension than the other cutting elements.

Figure 14:
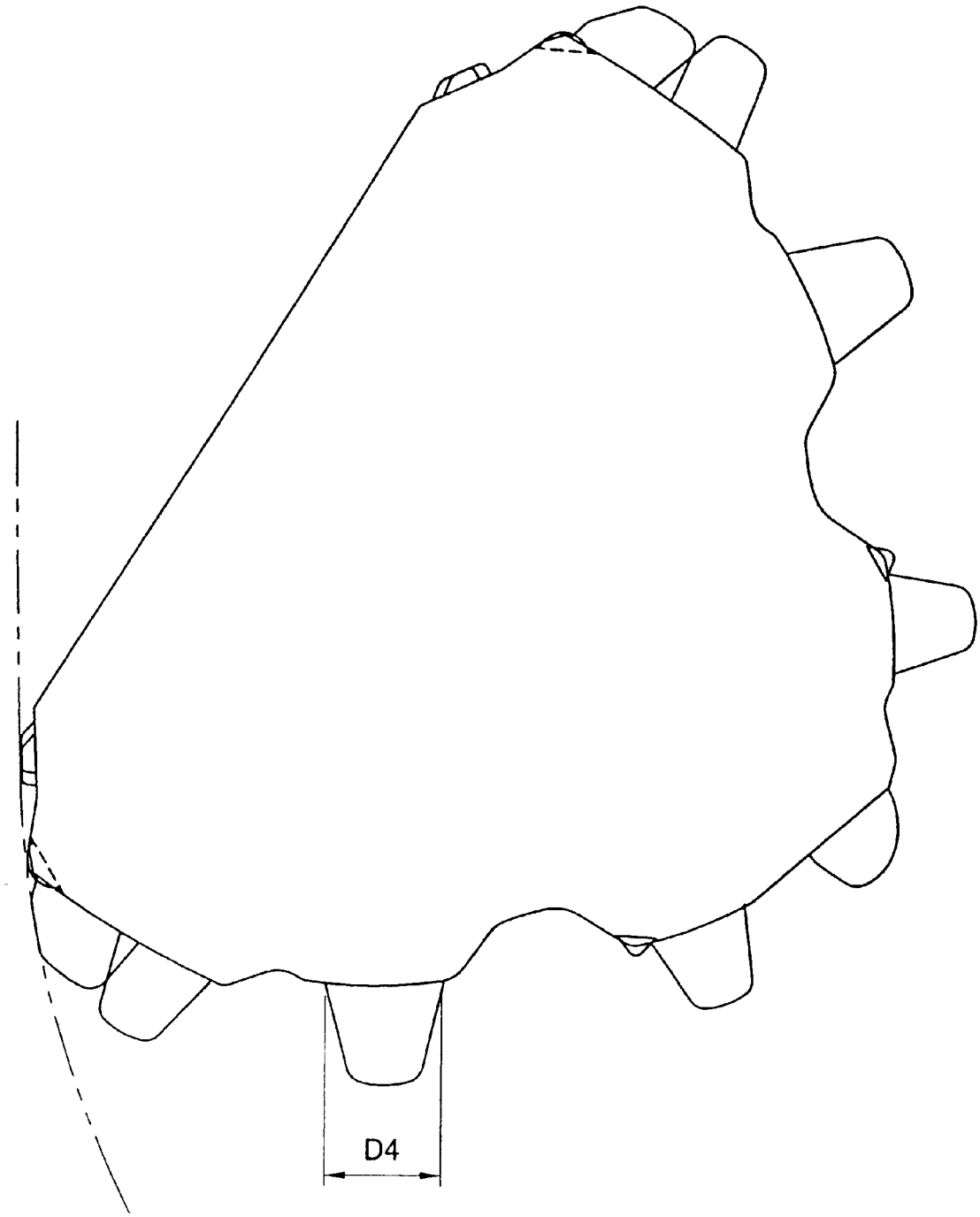
FIG. 14 shows an example of determining cutting element diameter for a cutting element formed integrally on a drill bit cone.

Finally, it should be understood that the various aspects of the invention can be implemented on drill bits in which the cutting elements are formed integrally with the body of the roller cone. In implementations of the invention which use "insert" type cutting elements, the diameter of the cutting element, for purposes of determining extension to diameter ratio, is generally equal to the diameter of the portion of the cutting element which is pressed into a cylindrical receiving socket formed into the cone body. Where the cutting elements are integrally formed with the cone body, such as for "milled tooth" drill bits, a diameter of the cutting element, for purposes of determining extension to diameter ratio, can be defined as a distance between the intersection of the outer side of the cutting element edge and the face of the cone body (cone shell surface), and the intersection of the cutting element inner edge and the cone shell surface. This is shown generally at D4 in FIG. 14. In cases where the cutting element is other than round at the base (at the intersection of the cone shell surface), the cutting element will generally have a major and minor diameter. The major diameter is the one used to determine the extension to diameter ratio for non-round cutting elements.

Those skilled in the art will appreciate that other embodiments of the invention can be devised which do not depart from the spirit of the invention as disclosed herein. Accordingly, the scope of the invention should be limited only by the attached claims.

What is claimed is:

1. A roller cone drill bit comprising:

a bit body having three legs depending therefrom, each leg having a journal, a roller cone rotatably mounted on each journal, each roller cone having a plurality of cutting elements thereon, the cutting elements arranged in rows on each cone, the rows including at least a gage row and a first row interior of the gage row, the first interior row staggered with respect to the gage row on each of the three cones, wherein a maximum distance between the cutting elements on the gage row and the first interior row on any one of the cones is about zero to 350 percent greater than a minimum distance between the cutting elements on the gage row and the first interior row on any other one of the cones.

2. The roller cone drill bit as defined in claim 1 wherein the cutting elements comprise tungsten carbide inserts.

3. The roller cone drill bit as defined in claim 1 wherein a maximum distance between the cutting elements on the gage row and the first interior row on any one of the cones is about 100 to 250 percent greater than a minimum distance between the cutting elements on the gage row and the first interior row on any other one of the cones.

4. The roller cone drill bit as defined in claim 1 wherein an area of a hole bottom surface cut by the ones of the cutting elements on the gage row and the first interior row on the three roller cones is between about 20 and 60 percent of a total area of the hole bottom cut by all the cutting elements on all the roller cones.

5. The roller cone drill bit as defined in claim 1 wherein the area of the hole bottom surface cut by the ones of the cutting elements on the gage row and the first interior row on the three roller cones is between about 30 and 40 percent of a total area of the hole bottom cut by all the cutting elements on all the roller cones.

6. The roller cone drill bit as defined in claim 1 wherein at least one of the cutting elements on the first interior row of at least one of the roller cones has a diameter smaller than the diameter of the other cutting elements on the first interior row or the gage row of the roller cones.

7. The roller cone drill bit as defined in claim 6 wherein the at least one smaller diameter cutting element is at most 50% smaller in diameter than the other cutting elements.

8. The roller cone drill bit as defined in claim 1 wherein at least one of the cutting elements on the first interior row or the gage row of at least one of the roller cones has a smaller extension than the extension of the other cutting elements on the first interior row or the gage row on the roller cones.

9. The roller cone drill bit as defined in claim 7 wherein the at least one smaller extension cutting element is at most 20 percent smaller in extension than the other cutting elements.

10. The roller cone drill bit as defined in claim 1 wherein an area of a hole bottom surface cut by the ones of the cutting elements on the gage row and the first interior row on the three roller cones forms a fraction of a total area of the hole bottom cut by all the cutting elements on all the roller cones defined according to a ratio of cutting element extension to diameter, the ratio and corresponding fraction of the total area being at least one of:

greater than 0.799, about 20 to 60 percent;

0.709 to 0.799, about 20 to 53 percent;

0.440 to 0.710, about 20 to 43 percent; and less than 0.440, about 20 to 35 percent.

11. The roller cone drill bit as defined in claim 1 wherein an area of a hole bottom surface cut by the ones of the cutting elements on the gage row and the first interior row on the three roller cones forms a fraction of a total area of the hole bottom cut by all the cutting elements on all the roller cones defined according to a ratio of cutting element extension to diameter, the ratio and corresponding fraction of the total area being at least one of:

greater than 0.799, about 30 to 55 percent;

0.709 to 0.799, about 20 to 45 percent;

0.440 to 0.710, about 20 to 33 percent; and less than 0.440, about 10 to 25 percent.

12. A roller cone drill bit comprising:

a bit body having three legs depending therefrom, each leg having a journal, a roller cone rotatably mounted on each journal, each roller cone having a plurality of cutting elements thereon, the cutting elements arranged in rows on each cone, the rows including at least a gage row and a first row interior of the gage row, the first interior row staggered with respect to the gage row on at least two of the three cones, the cutting elements having an extension to diameter ratio of at least 0.829.

13. The roller cone drill bit as defined in claim 12 wherein a maximum distance between the cutting elements on the gage row and the first interior row on any one of the at least two roller cones is about zero to 350 percent greater than a minimum distance between the cutting elements on the gage row and the first interior row on any other one of the at least two roller cones.

14. The roller cone drill bit as defined in claim 13 wherein a maximum distance between the cutting elements on the gage row and the first interior row on any one of the cones is about 100 to 250 percent greater than a minimum distance between the cutting elements on the gage row and the first interior row on any other one of the cones.

15. The roller cone drill bit as defined in claim 12 wherein an area of a hole bottom surface cut by the ones of the cutting elements on the gage row and the first interior row is between about 20 and 60 percent of a total area of the hole bottom cut by all the cutting elements.

16. The roller cone drill bit as defined in claim 12 wherein an area of a hole bottom surface cut by the ones of the cutting elements on the gage row and the first interior row is between about 40 and 60 percent of a total area of the hole bottom cut by all the cutting elements.

17. The roller cone drill bit as defined in claim 12 wherein at least one of the cutting elements on the first interior row of at least one of the roller cones has a diameter smaller than the diameter of the other cutting elements on the first interior row or gage row.

18. The roller cone drill bit as defined in claim 17 wherein the at least one cutting element has a diameter at most 50 percent smaller than the diameter of the other cutting elements.

19. The roller cone drill bit as defined in claim 12 wherein at least one of the cutting elements on the first interior row of at least one of the roller cones has an extension smaller than the extension of the other cutting elements on the first interior row or gage row.

20. The roller cone drill bit as defined in claim 19 wherein the at least one cutting element has an extension at most 20 percent less than the extension of the other cutting elements.

21. A roller cone drill bit, comprising:

a bit body having three legs depending therefrom, each leg having a journal, a roller cone rotatably mounted on each journal, each roller cone having a plurality of cutting elements thereon, the cutting elements arranged in rows on each cone, the rows including at least a gage row and a first row interior of the gage row;

wherein a fractional amount of a hole bottom area defined by the cutting elements in the gage row and the first interior row is less than a boundary amount defined with respect to a cutting element extension to diameter ratio, the boundary amount substantially conforming to values of the ratio 0.330, 0.436, 0.49, 0.52, 0.56, 0.658, 0.688, 0.747, 0.769, 0.8, 0.875, 1.04 and corresponding fractional amounts of 42.30, 36.44, 48.32, 50.67, 50.65, 51.80, 45.3, 49.53, 54.45, 58.08, 60.88, 61.81, and 65.57 percent.

22. The roller cone drill bit as defined in claim 21 wherein the cutting elements on the gage row and the first interior row are staggered on at least two of the roller cones.

23. The roller cone drill bit as defined in claim 21 wherein the cutting elements on the gage row and the first interior row are staggered on all three roller cones.

24. The roller cone drill bit as defined in claim 21 wherein the boundary amount is defined by each of the corresponding fractional amounts being reduced by about 5 to 30 percent of the values 42.30, 36.44, 48.32, 50.67, 50.65, 51.80,45.3, 49.53, 54.45, 58.08, 60.88, 61.81, and 65.57 percent.

25. The roller cone drill bit as defined in claim 21 wherein each of the corresponding fractional amounts is reduced by about 10 to 20 percent of the values 42.30, 36.44, 48.32, 50.67, 50.65, 51.80, 45.3, 49.53, 54.45, 58.08, 60.88, 61.81, and 65.57 percent.

26. The roller cone drill bit as defined in claim 21 wherein a maximum distance between the cutting elements on the gage row and the first interior row on any one of the roller cones is about zero to 350 percent greater than a minimum distance between the cutting elements on the gage row and the first interior row on any other one of the roller cones.

27. The roller cone bit as defined in claim 26 wherein the maximum distance is about 100 to 250 percent greater than the minimum distance.

28. The roller cone drill bit as defined in claim 21 wherein at least one of the cutting elements on the first interior row of at least one of the roller cones has a diameter smaller than the diameter of the other cutting elements on the first interior row or gage row.

29. The roller cone drill bit as defined in claim 28 wherein the at least one cutting element has a diameter at most 50 percent less than the diameter of the other cutting elements.

30. The roller cone drill bit as defined in claim 21 wherein at least one of the cutting elements on the first interior row of at least one of the roller cones has an extension smaller than the extension of the other cutting elements on the first interior row or gage row.

31. The roller cone drill bit as defined in claim 30 wherein the at least one cutting element has an at most 20 percent shorter than the extension of the other cutting elements.

32. A roller cone drill bit, comprising:

a bit body having three legs depending therefrom, each leg having a journal, a roller cone rotatably mounted on each journal, each roller cone having a plurality of cutting elements thereon, the cutting elements arranged in rows on each cone, the rows including at least a gage row and a first row interior of the gage row;

wherein a bottom hole area cut by the cutting elements in the gage row and the first interior row on all the roller cones forms a fractional amount of the total area cut by all the cutting elements on all the roller cones defined with respect to a cutting element extension to diameter ratio, the ratio and corresponding fractional amount of the total area being at least one of:

greater than 0.799, about 20 to 60 percent;

0.709 to 0.799, about 20 to 53 percent;

0.440 to 0.710, about 20 to 43 percent; and less than 0.440, about 20 to 35 percent.

33. The roller cone drill bit as defined in claim 32 wherein the cutting elements on the gage row and first interior row are staggered on at least two of the roller cones.

34. The roller cone drill bit as defined in claim 32 wherein the cutting elements on the gage row and first interior row are staggered on all three of the roller cones.

35. The roller cone drill bit as defined in claim 32 wherein at least one of the cutting elements on the first interior row of at least one of the roller cones has a diameter at most 50 percent smaller than the diameter of the other cutting elements on the roller cones.

36. The roller cone drill bit as defined in claim 32 wherein at least one of the cutting elements on the first interior row of at least one of the roller cones has an extension at most 20 percent smaller than the extension of the other cutting elements on the roller cones.

37. The roller cone drill bit as defined in claim 32 wherein a maximum distance between the cutting elements on the gage row and the first interior row on any one of the roller cones is about zero to 350 percent greater than a minimum distance between the cutting elements on the gage row and the first interior row on any other one of the roller cones.

38. The roller cone drill bit as defined in claim 37 wherein the maximum distance is about 100 to 250 percent greater than the minimum distance.

39. The roller cone drill bit as defined in claim 31 wherein the ratio and corresponding fraction of the total area comprise at least one of:

greater than 0.799, about 30 to 55 percent;

0.709 to 0.799, about 20 to 45 percent;

0.440 to 0.710, about 20 to 33 percent; and less than 0.440, about 10 to 25 percent.

* * * * *